US006173772B1

(12) United States Patent
Vaynshteyn

(10) Patent No.: US 6,173,772 B1
(45) Date of Patent: Jan. 16, 2001

(54) CONTROLLING MULTIPLE DOWNHOLE TOOLS

(75) Inventor: Vladimir Vaynshteyn, Sugar Land, TX (US)

(73) Assignee: Schlumberger Technology Corporation, Sugar Land, TX (US)

( * ) Notice: Under 35 U.S.C. 154(b), the term of this patent shall be extended for 0 days.

(21) Appl. No.: 09/298,024

(22) Filed: Apr. 22, 1999

Related U.S. Application Data

(60) Provisional application No. 60/082,660, filed on Apr. 22, 1998.

(51) Int. Cl.[7] ..... E21B 44/00

(52) U.S. Cl. ..... 166/250.15; 166/386; 166/387; 166/250.17; 166/374

(58) Field of Search ..... 166/53, 65.1, 66.4, 166/250.01, 250.15, 250.17, 373, 374, 386, 387

(56) References Cited

U.S. PATENT DOCUMENTS 3,971,317 7/1976 Gemmell et al. .
4,078,620 3/1978 Westlake et al. .
4,632,034 * 12/1986 Colle .
4,856,595 8/1989 Upchurch .
4,896,722 1/1990 Upchurch .
4,971,160 11/1990 Upchurch .
5,056,600 * 10/1991 Surjaatmadja et al. ..... 166/373
5,691,712 11/1997 Meek et al. .

FOREIGN PATENT DOCUMENTS 0 456 415 A2 11/1991 (EP) .

* cited by examiner

*Primary Examiner*—Roger Schoeppel
(74) *Attorney, Agent, or Firm*—Trop, Pruner & Hu PC

(57) ABSTRACT

A system used in a subterranean well has a command generator (e.g., a manually operated mud pump) that is configured to furnish a first command stimulus (e.g., pressure pulses having a predetermined signature) downhole. A first assembly (e.g., a testing tool) of the system is located downhole and has a first member (e.g., a valve) that is connected to move the first member in response to the first command stimulus. The movement of the first member generates a second command stimulus, and a second assembly of the system, also located downhole, is connected to respond to the second command stimulus.

24 Claims, 15 Drawing Sheets

CONTROLLING MULTIPLE DOWNHOLE TOOLS

CROSS-REFERENCE TO RELATED APPLICATIONS

This application claims priority under 35 U.S.C. § 119 to U.S. Provisional Patent Application Ser. No. 60/082,660, filed on Apr. 22, 1998.

BACKGROUND

The invention relates to controlling multiple downhole tools.

Referring to FIG. 1, for purposes of measuring characteristics (e.g., formation pressure) of a subterranean formation 31, a tubular test string 10 is typically inserted into a wellbore which extends into the formation 31. In order to test a particular region, or zone 33, of the formation 31, the test string 10 may have a perforating gun 30 that is used to penetrate a well casing 12 and form fractures 29 in the formation 31. To seal off the zone 33 from the surface of the well, the test string 10 typically includes a packer 26 that forms a seal between the exterior of the test string 10 and the internal surface of the well casing 12. Below the packer 26, a recorder 11 of the test string 10 takes measurements of the test zone 33.

The test string 10 typically has valves to control the flow of fluid into and out of a central passageway of the test string 10. An in-line ball valve 22 is used to control the flow of well fluid from the test zone 33 up through the central passageway of the test string 10. Above the packer 26, a circulation valve 20 is used to control fluid communication between an annulus 16 surrounding the test string 10 and the central passageway of the test string 10.

The ball valve 22 and the circulation valve 20 may be controlled by commands (e.g., "open valve" or "close valve") sent downhole. Each command is encoded into a predetermined signature of pressure pulses 34 (see FIG. 2) that are transmitted downhole to the tool 11 via hydrostatic fluid present in the annulus 16. A sensor 25 of the tool 11 receives the pressure pulses 34, and subsequently, electronics and hydraulics of the test string 10 operate the valves 20 and 22 to execute the command.

For purposes of generating the pressure pulses 34, a port 18 in the casing 12 extends to a manually operated mud pump (not shown). The mud pump is selectively turned on and off by an operator to encode the command into the pressure pulses 34. A duration $T_0$ (e.g., 1 min.) of the pulse 34, a pressure $P_0$ (e.g., 250 p.s.i.) of the pulse 34, and the number of pulses 34 in succession form the signature that uniquely identifies the command.

SUMMARY

In one embodiment, the invention features a system for use in a subterranean well. The system has a command generator that is configured to furnish a first command stimulus downhole. The system includes a first assembly located downhole and has a first member. The first assembly is connected to move the first member in response to the first command stimulus, and the movement of the first member generates a second command stimulus. The system also includes a second assembly located downhole. The second assembly is connected to respond to the second command stimulus.

Advantages and other features of the invention will become apparent from the following description, from the drawing and from the claims.

DETAILED DESCRIPTION

Figure 1:
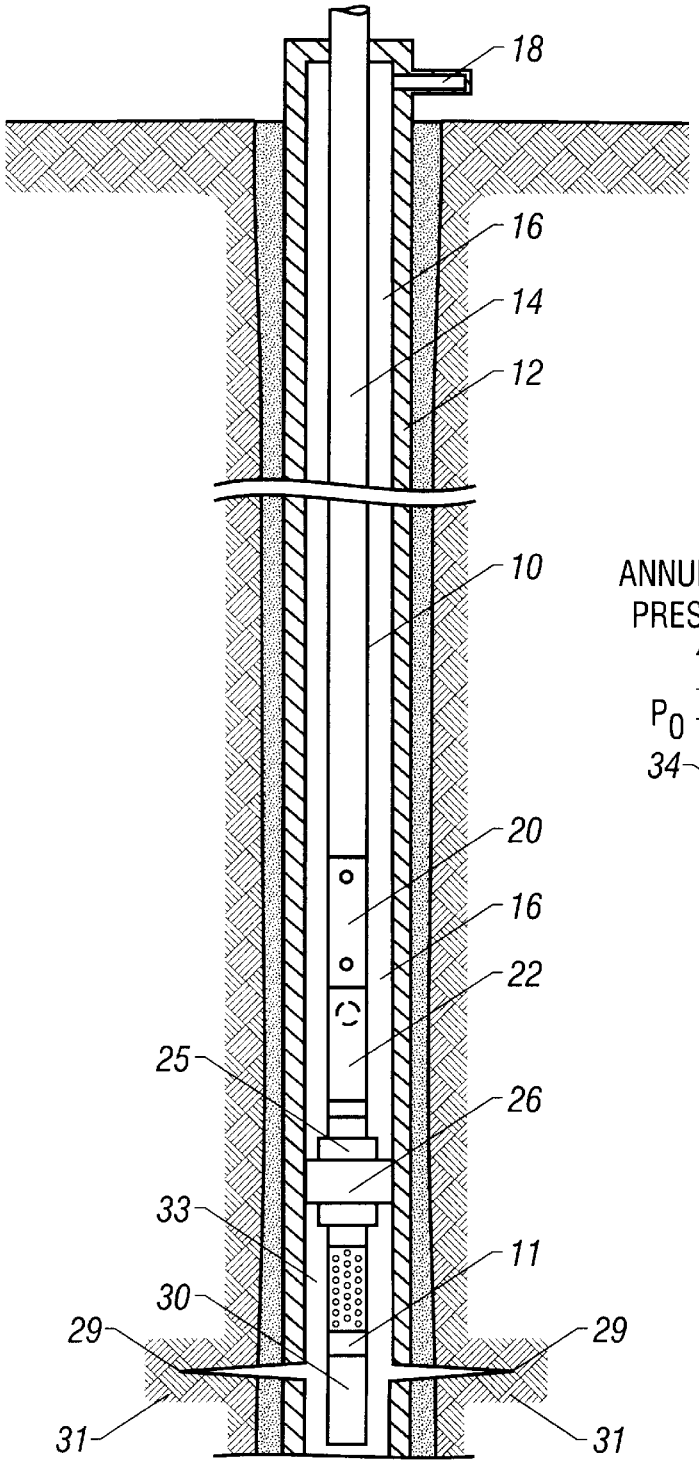
FIG. 1 (PRIOR ART)
FIG. 1 is a schematic view of a test string in a well being tested.
Figure 2:
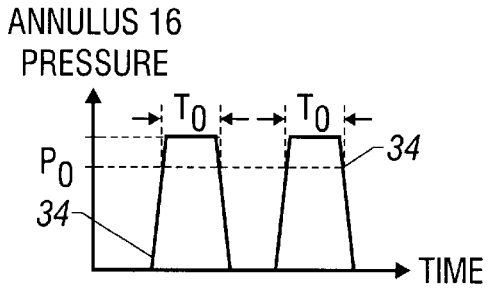
FIG. 2 (PRIOR ART)
FIG. 2 is a waveform illustrating a pressure pulse command for a tool of the test string of FIG. 1.
Figure 3A:
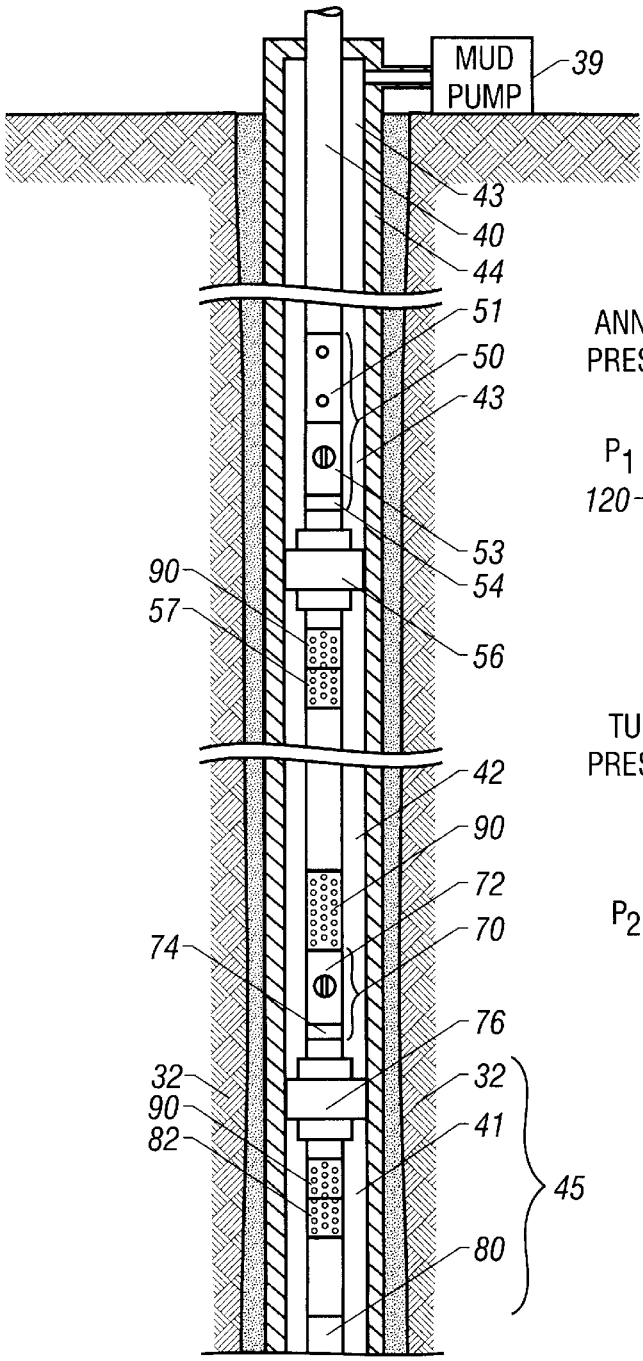
FIGS. 3A, and 4–9 are schematic views of a string that includes multiple valves and packers.
Figure 3B:
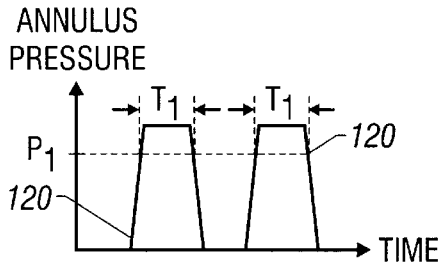
FIGS. 3B and 3C are waveforms illustrating pressure pulses transmitted to tools of the test string.
Figure 3C:
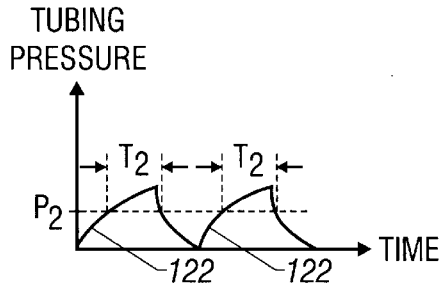

As shown in FIGS. 3A–3C, a tubular test string 40 having two in-line testing tools 50 and 70 is located inside a well. To send a command (e.g., "open valve" or "close valve") downhole to the upper tool 50, a mud pump 39 is used to encode the command into a series of pressure pulses 120 (i.e., a command stimulus) which are applied to hydrostatic fluid present in an upper annulus 43. The upper tool 50 has a sensor 54 in contact with the hydrostatic fluid in the upper annulus 43. The upper tool 50 uses the sensor 54 to identify the signature of the pressure pulses 120 and, thus, extract the encoded command. In response to the appropriate commands, the upper tool 50 is constructed to actuate an in-line ball valve 53 and/or a circulation valve 51.

The upper annulus 43 is the annular space above a packer 56 which forms a seal between the exterior of the upper tool 50 and the interior of a well casing 44. Because the lower tool 70 is located below the packer 56, the fluid in the upper annulus 43 cannot be used as a medium to directly send pressure pulses (and thus commands) to the lower tool 70. However, because a central passageway of the test string 40 extends through the packer 56, this central passageway may be used as a conduit for passing commands to the lower tool 70. As described below, commands are sent to the lower tool 70 by using the ball valve 53 of the upper tool 50 to form pressure pulses 122 in well fluid (e.g., oil, gas, water, or a mixture of these fluids) present in a lower annulus 42 below the packer 56. The lower tool 70 has a sensor 74 in contact with fluid in the lower annulus 42. The lower tool 70 uses the sensor 74 to receive the pulses 122 and, thus, extract the commands sent by the upper tool 50.

Thus, commands are sent to the lower tool 70 by the upper tool 50. More particularly, to send a command to the lower tool 70, the mud pump 39 first creates pressure pulses 120 in the fluid in the upper annulus 43. The pressure pulses may be either negative or positive changes in pressure, and the pressure pulses 120 form a signature that indicates a command for the lower tool 70. In this manner, the upper tool 50 receives the pressure pulses 120, decodes the command from the pulses 120, and selectively opens and closes the ball valve 53 to send the command to the lower tool 70 via pressure pulses 122. The pressure pulses 122 are applied to a column of well fluid existing in the central passageway of the string 40 where the string 40 extends through the packer 56. Perforated tailpipes 90 of the string 40 establish fluid communication between the central passageway of the string 40, the annulus 43, an annulus 42 and an annulus 41. For example, perforated tailpipes 90 may be located above and below a perforating gun 57 (of the string 40) that is located in the annulus 42. In this manner, the tailpipes 90 establish fluid communication between the central passageway of the string 40 and the annulus 42. Thus, due to this arrangement, the pressure pulses 122 that are formed by the upper tool 50 propagate to the lower annulus 42. As a result, the lower tool 70 uses the sensor 74 to identify the unique signature of the pulses 122 and thus, extract the command. After extracting the command, the lower tool 70 executes the command.

The advantages of the above-described arrangement may include one or more of the following: tools below the packer may be controlled without extending wires or pressurized hydraulic lines through the packer; additional electronics may not be required; and additional hydraulics may not be required.

Besides the sensor 54 and the ball valve 53, the upper tool 50 may include a circulation valve 51 and electronics that are configured to decode the signature of the pressure pulses 120 and to control the valves 53 and 51 accordingly. A recorder (not shown) may be located below the packer 56 for taking measuring characteristics of fluid in the lower annulus 42.

In some embodiments, the string 40 may includes a perforated tailpipe 90 that is located above a ball valve 72 of the lower tool 70. As controlled by the ball valve 72, the tailpipe 71 allows fluid communication between the lower annulus 42 and a central passageway of the string 40 that extends through the packer 76. The packer 76 forms a seal between the exterior of the lower tool 70 and the interior of the well casing 44, thereby forming a test zone 45 and an annulus 41 below the packer 76.

The lower tool 70 also has electronics to decode the pressure pulses 122 and to operate the ball valve 72 accordingly. Located below the packer 76 are a perforating gun 82 that may be between two perforated tailpipes 90 that establish fluid communication between the central passageway of the test string 40 (extending through the packer 76) and the annulus 41, as controlled by the ball valve 72. A recorder 80 may also be located below the packer 76 to take measurements in the test zone 45.

As an example, the string 40 may be inserted into the well to perforate and measure characteristics of a formation 32 using a process, such as is described below. The circulation valve 51 remains closed except when fluid communication between the upper annulus 42 and the central passageway of the string 40 needs to be established.

Figure 4:
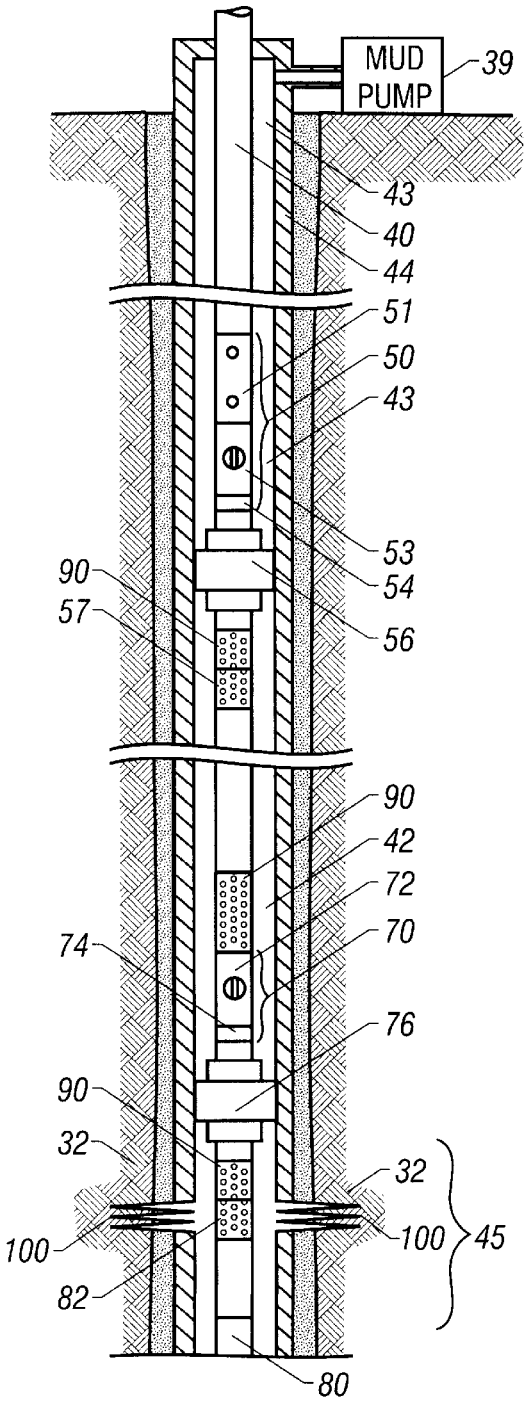

To begin the process, as shown in FIG. 3A, the test string 40 is inserted into the well with both ball valves 53 and 72 opened. Next, as shown in FIG. 4, pressure is applied through the tubular test string 40 to detonate the perforating gun 82. When detonated, shape charges in the gun 82 form lateral fractures 100 in the formation 32 and well casing 44 below the packer 76.

Figure 5:
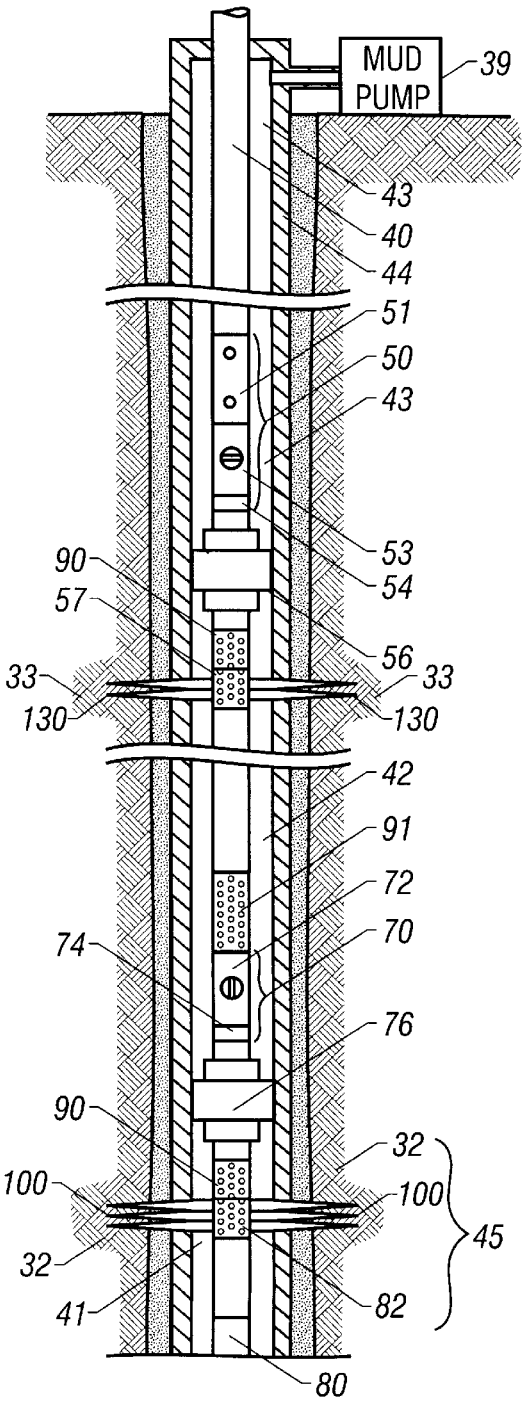

As shown in FIG. 5, once the perforations 100 are formed, the mud pump 39 is used to send a command to the upper tool 50 to close the ball valve 53. Tests are then conducted in the zone 45 to measure characteristics of the perforations 100. After the tests are complete, a column of well fluid exists in the central passageway of the test string 40 below the ball valve 53.

Figure 6:
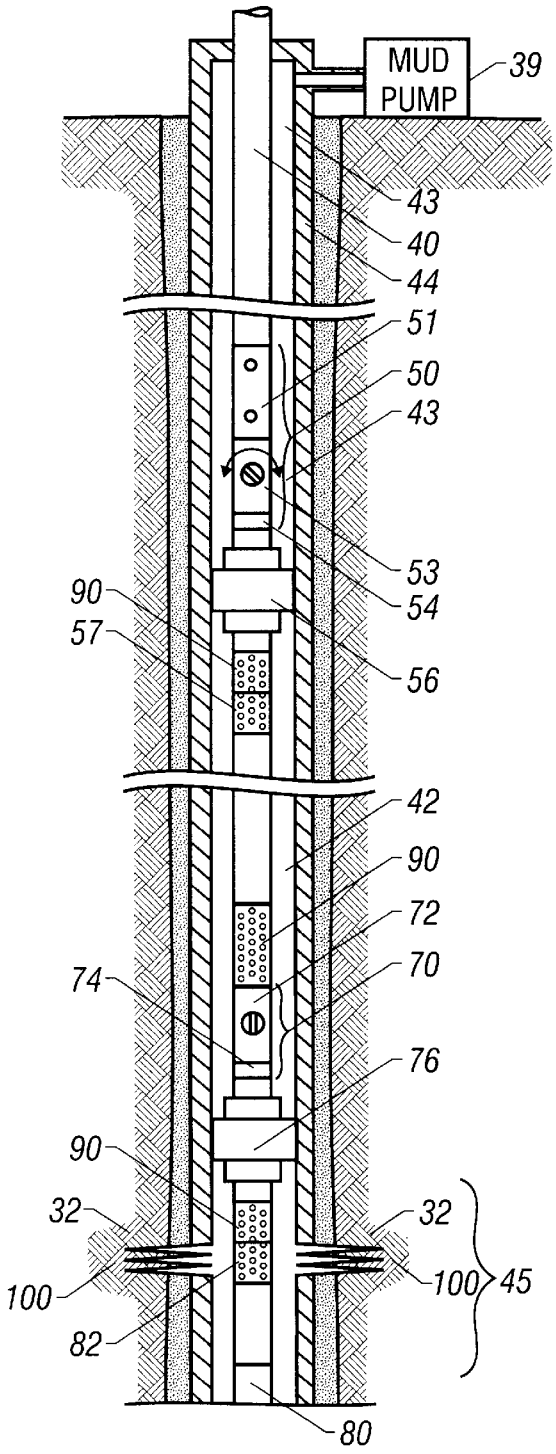

As shown in FIG. 6, once the testing of the zone 45 is complete, a process is performed to seal off the zone 45. To accomplish this, the mud pump 39 instructs the upper tool 50 to open and close the ball valve 53 in a manner to generate pressure pulses in the column of well fluid below the ball valve 53. These pressure pulses have a predetermined signature indicative of a command for the lower tool 70 to close the ball valve 72. When the lower tool 70 recognizes this signature (via the sensor 74), the lower tool 70 closes the ball valve 72 and seals off the zone 45.

Figure 7:
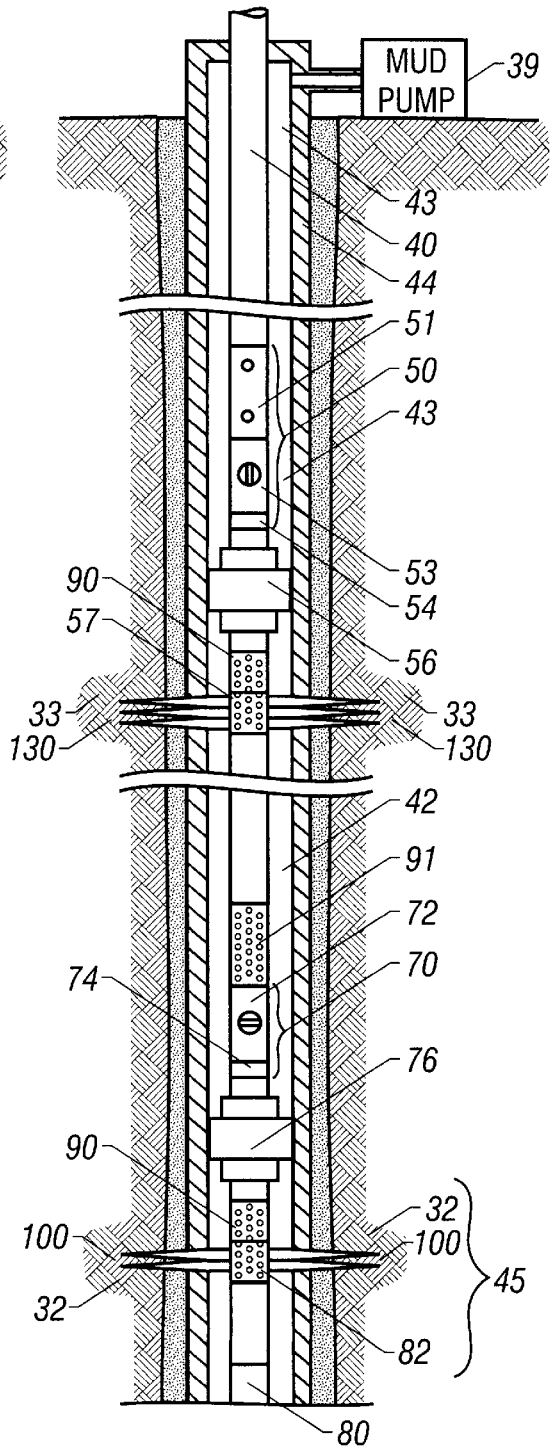

As shown in FIG. 7, once the ball valve 72 has been closed, the perforating gun 59 is detonated to form another set of perforations 130 in another formation 33. Because the ball valve 53 is open, the well fluid flows upwardly through the perforated tailpipe 57 and past the packer 56. The formation 33 is then tested using the upper tool 50.

Figure 8:
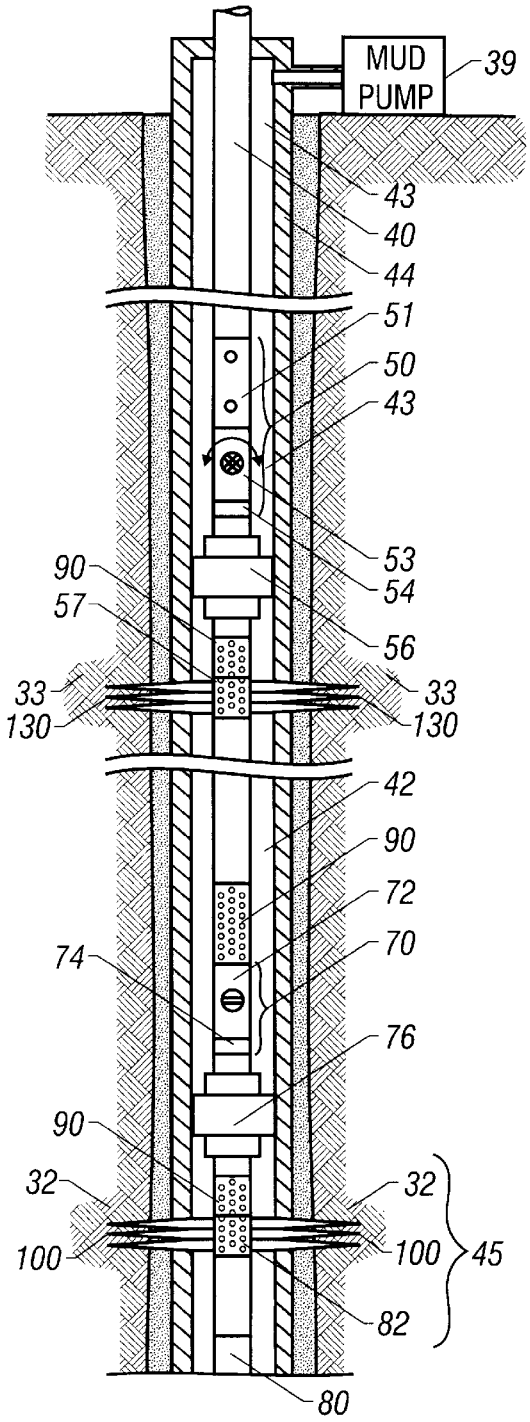
Figure 9:
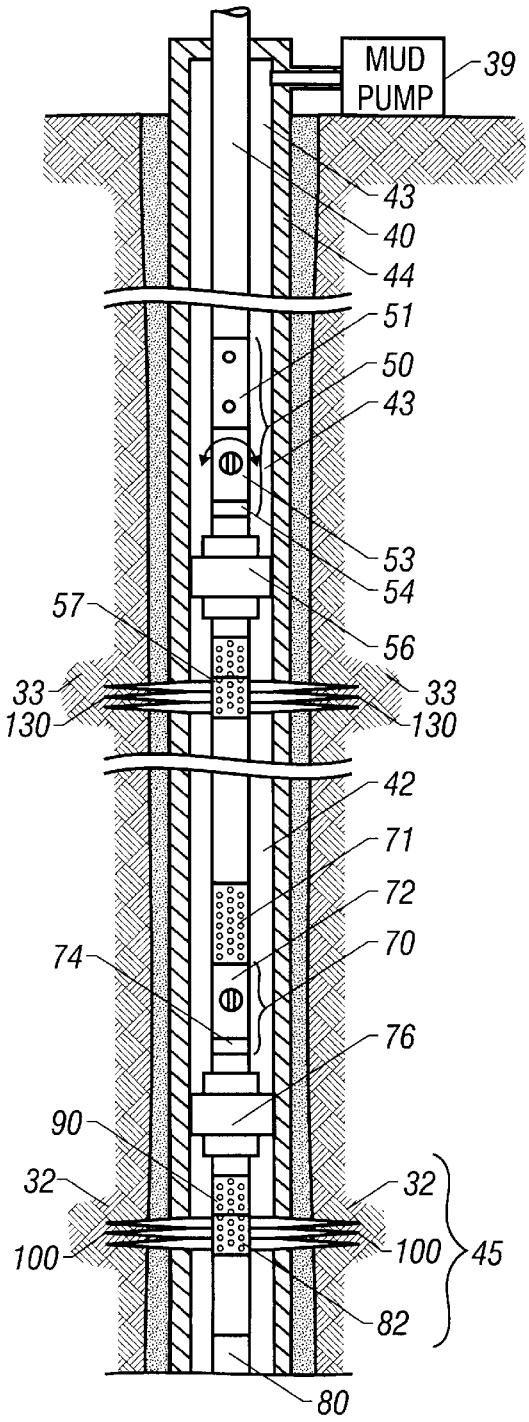

As shown in FIG. 8, once the testing of the formation 33 is complete, the mud pump 39 then sends commands to the upper tool 50 to open and close the ball valve 53 in a manner to generate pressure pulses in the column of well fluid below the ball valve 53. These pressure pulses have a predetermined signature indicative of a command for the lower tool 70 to open the ball valve 72. When the lower tool 70 recognizes this signature, the lower tool 70 opens the ball valve 72, and the formations 32 and 33 are tested together.

The testing procedure described above requires that a column of well fluid exists below the ball valve 53. Sufficient pressure (typically exerted by the fluid in the formations 32 and 33) must also be exerted on the column so that the opening and closing of the valve 53 produces pressure variations (FIG. 3B) large enough for the sensor 74 to detect. If the formations 32 and 33 do not exert sufficient pressure, the circulation valve 51 may be opened and another fluid, such as a light gas (e.g., nitrogen), is injected into the central passageway of the string 40 above the ball valve 53. The gas displaces the well fluid above the valve 53 to reduce the hydrostatic pressure above the ball valve 53 and create a pressure difference necessary for generating the pressure pulses 122. Alternatively, a fluid, such as a formation "kill" fluid, may be injected into the central passageway of the string 40 and the lower annulus 42 so that the pump 39 may be used to send commands to the tool 70.

Figure 10:
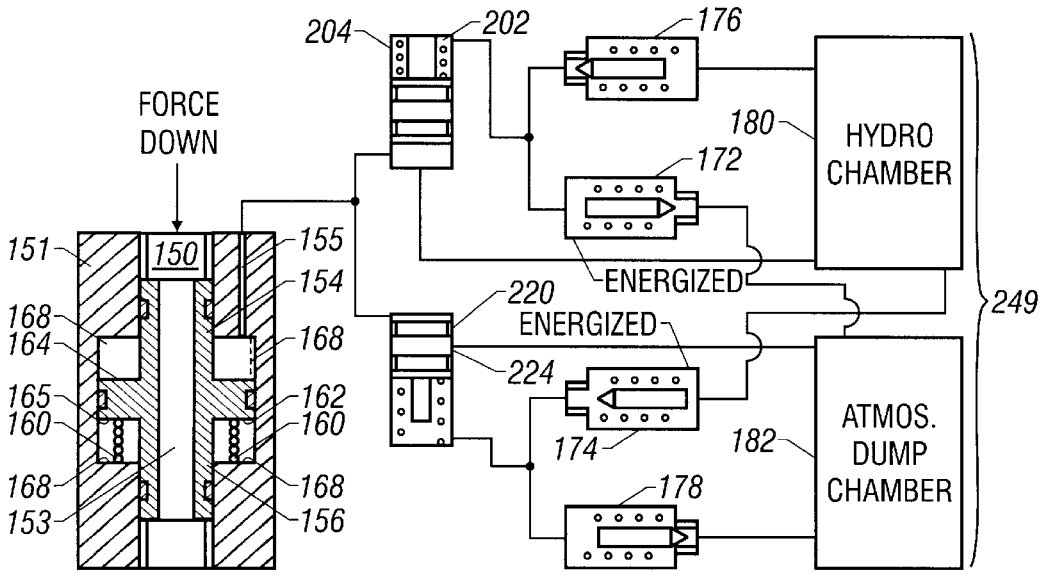
FIG. 10 is a block diagram of a hydraulic system to control valves of the tools.

Each of the tools 50 and 70 use hydraulics 249 (FIG. 10) and electronics 250 (FIG. 11) to operate the valves. As shown in FIG. 10, each valve uses a hydraulically operated tubular member 156 which through its longitudinal movement, opens and closes one of the valves. The member 156 is slidably mounted inside a tubular housing 151 of the test string 40. The member 156 includes a tubular mandrel 154 having a central passageway 153 coaxial with a central passageway 150 of the housing 151. The member 156 also has an annular piston 162 radially extending from the exterior of the mandrel 154. The piston 162 resides inside a chamber 168 formed in the tubular housing 151.

The member 156 is forced up and down by using a port 155 in the housing 151 to change the force applied to an upper face 164 of the piston 162. Through the port 155, the face 164 is subjected to either a hydrostatic pressure (a pressure greater than atmospheric pressure) or to atmospheric pressure. A compressed coiled spring 160 contacting a lower face 165 of the piston 162 exerts upward forces on the piston 162. When the upper face 164 is subject to atmospheric pressure, the spring 160 forces the member 156 upward. When the upper face 164 is subject to hydrostatic pressure, the piston 162 is forced downward.

The pressures on the upper face 164 are established by connecting the port 155 to either a hydrostatic chamber 180 (furnishing hydrostatic pressure) or an atmospheric dump chamber 182 (furnishing atmospheric pressure). Four solenoid valves 172–178 and two pilot valves 204 and 220 are used to selectively establish fluid communication between the chambers 180 and 182 and the port 155.

The pilot valve 204 controls fluid communication between the hydrostatic chamber 180 and the port 155, and the pilot valve 220 controls fluid communication between the atmospheric dump chamber 182 and the port 155. The pilot valves 204 and 220 are operated by the application of hydrostatic and atmospheric pressure to control ports 202 (pilot valve 204) and 224 (pilot valve 220). When hydrostatic pressure is applied to the control port the valve is closed, and when atmospheric pressure is applied to the control port, the valve is open.

The solenoid valve 176 controls fluid communication between the hydrostatic chamber 180 and the control port 202. When the solenoid valve 176 is energized, fluid communication is established between the hydrostatic chamber 180 and the control port 202, thereby closing the pilot valve 204. The solenoid valve 172 controls fluid communication between the atmospheric dump chamber 182 and the control port 202. When the solenoid valve 172 is energized, fluid communication is established between the atmospheric dump chamber 182 and the control port 202, thereby opening the pilot valve 204.

The solenoid valve 174 controls fluid communication between the hydrostatic chamber 180 and the control port 224. When the solenoid valve 174 is energized, fluid communication is established between the hydrostatic chamber 180 and the control port 224, thereby closing the pilot valve 220. The solenoid valve 178 controls fluid communication between the atmospheric dump chamber 182 and the control port 224. When the solenoid valve 178 is energized, fluid communication is established between the atmospheric dump chamber 182 and the control port 224, thereby opening the pilot valve 220.

Thus, to force the moving member 156 downward, (which opens the valve) the electronics 250 of the tool energize the solenoid valves 172 and 174. To force the moving member 156 upward (which closes the valve), electronics 250 energize the solenoid valves 176 and 178. The hydraulics of the tool are further described in U.S. Pat. No. 4,915,168, entitled "Multiple Well Tool Control Systems in a Multi-Valve Well Testing System," which is hereby incorporated by reference.

Figure 11:
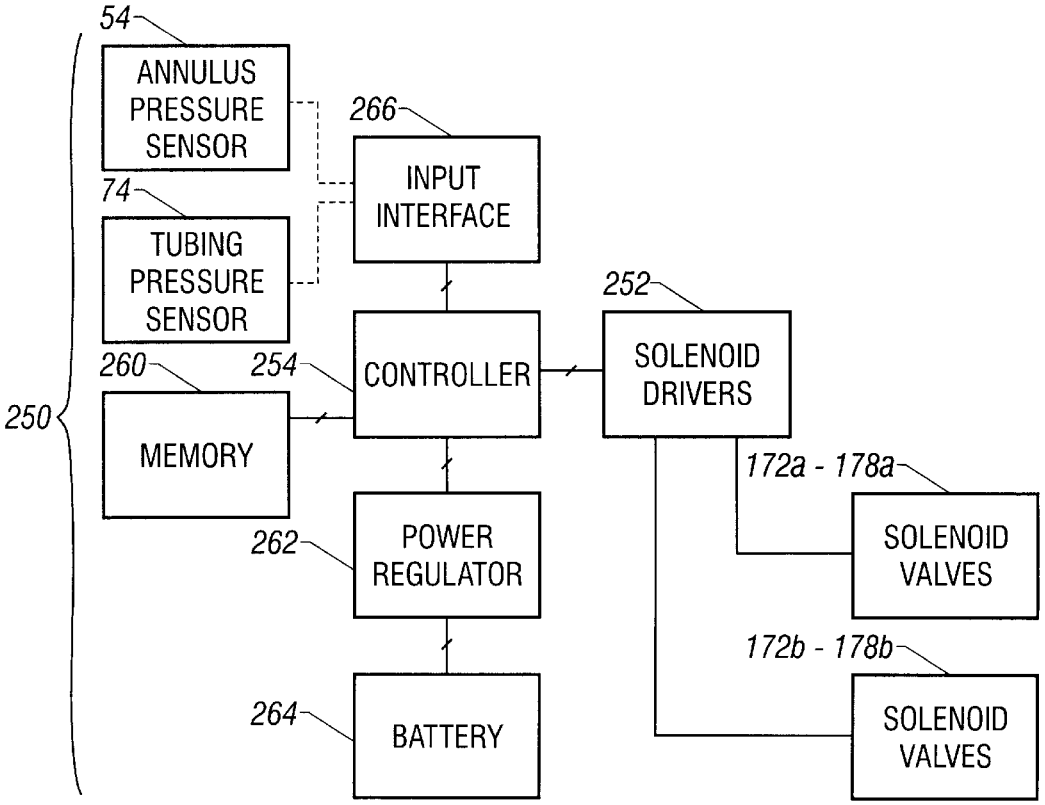
FIG. 11 is a block diagram of electronics to control valves of the tools.

As shown in FIG. 11, the electronics 250 for each of the tools 50 and 70 include a controller 254 which, through an input interface 266, may monitor an annulus pressure sensor (e.g., the sensor 54 or 74). Based on the command pressure pulses received by these, the controller 254 uses solenoid drivers 252 to operate the solenoid valve set 172*a*–178*a* for the ball valve and a solenoid valve set 172*b*–178*b* for the circulation valve.

The controller 254 executes programs stored in a memory 260. The memory 260 may either be a non-volatile memory, such as a read only memory (ROM), an electrically erasable programmable read only memory (EEPROM), or a programmable read only memory (PROM). The memory 260 may be a volatile memory, such as a random access memory (RAM). The battery 264 (regulated by a power regulator 262) furnishes power to the controller 254 and the other electronics of the tool.

Figure 12:
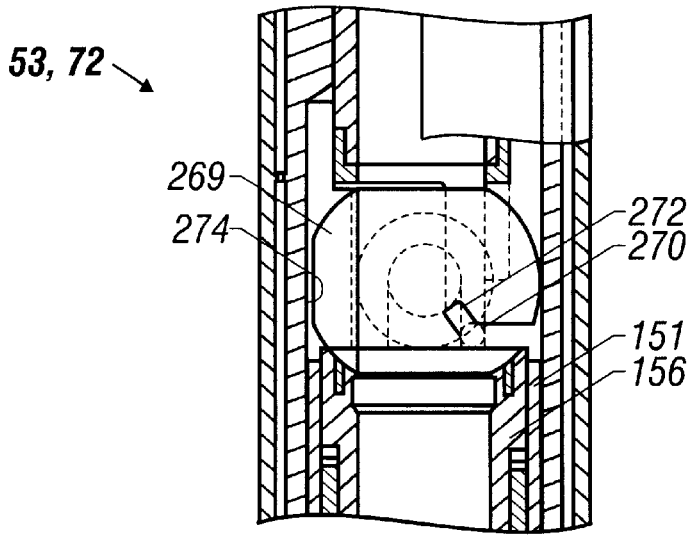
FIG. 12 is a cut-away view of the test string illustrating operation of the ball valve.

As shown in FIG. 12, each of the ball valves 53 and 72 includes a spherical ball element 269 which has a through passage 274. An arm 275 attached to the moving member 156 engages an eccentric lug 270 which is attached through radial slots 272 to the element 269. By moving the member 156 up and down, the ball element 269 rotates on an axis perpendicular to the coaxial axis of the central passageway 150, and the through passage 274 moves in and out of the central passageway 150 to open and close the ball valve, respectively.

Figure 13:
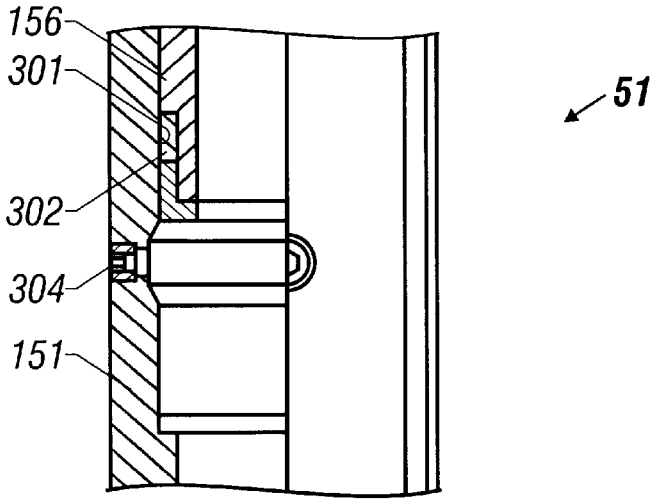
FIG. 13 is a cut-away view of the test string illustrating operation of the circulation valve.

As shown in FIG. 13, for the circulation valve 51, the housing 151 has a radial port 304 extending from outside of the tool, through the housing 151, and into the central passageway 150. A seal 302 located in a recess 301 on the exterior of the member 156 is used to open and close the circulating port 304. By moving the member 156 up and down, the circulation valve 51 is opened and closed, respectively.

Figure 14:
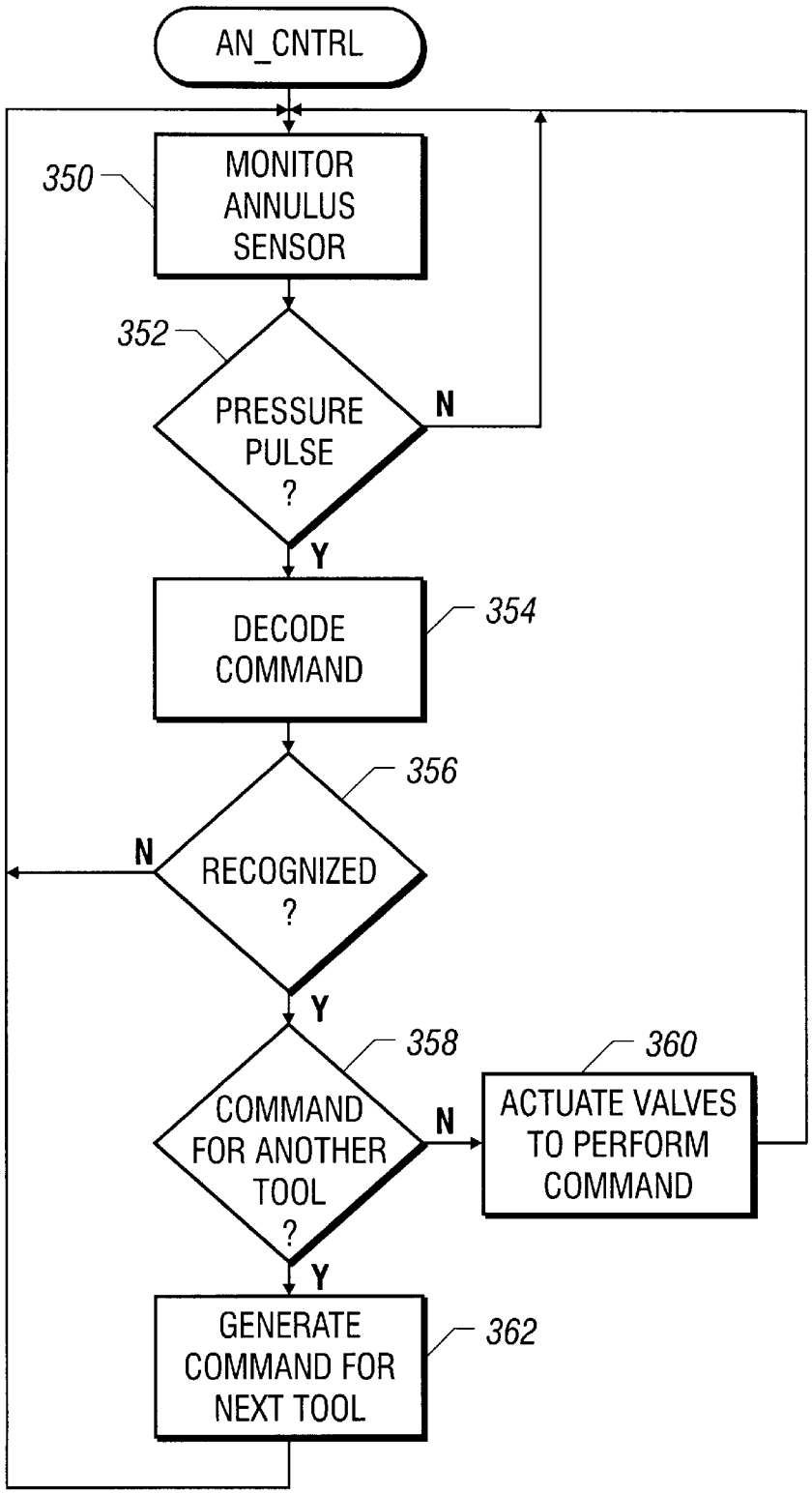
FIGS. 14 and 15 are flow diagrams illustrating the operation of electronics of tools of the test string.

As shown in FIG. 14, the controller 254 of the upper tool 50 executes a routine called AN_CNTRL to decode commands sent by the mud pump 39 and actuate the ball valve 53 accordingly. In the AN_CNTRL routine, the controller 254 monitors 350 the pressure via the sensor 54. If the controller 254 determines 352 that a pressure pulse has not been detected, then the controller 254 returns to step 350. However, if a pressure pulse has been detected, the controller 254 then decodes 354 the command. If the controller 254 does not recognize 356 the command, then the controller 254 returns to step 350. Otherwise, the controller 254 determines 358 whether the command is for another downhole tool (i.e., the lower tool 70). If not, then the controller 254 actuates 360 the valves 51 and 53 to carry out the command and returns to step 350. If the controller 254 determines 358 that the command was for the lower tool 70, then the controller 258 actuates 362 the ball valve 53 to send the command down to the lower tool 70.

Figure 15:
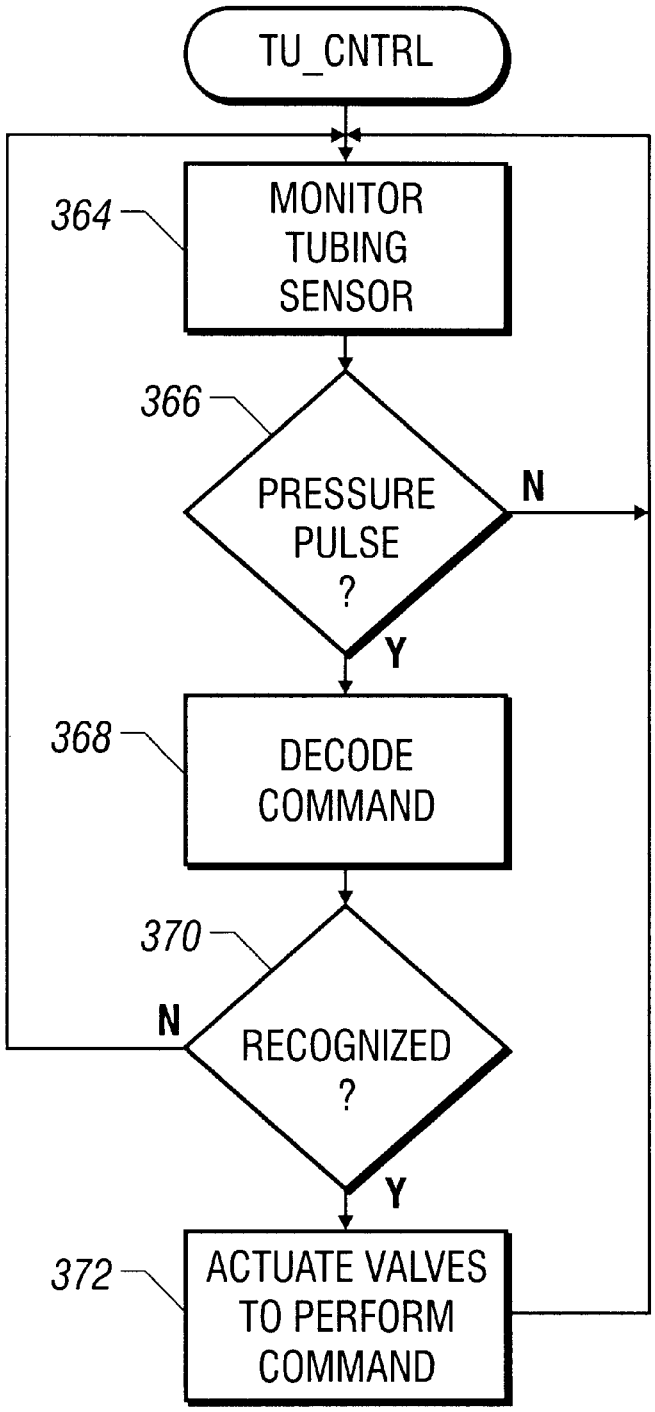

As shown in FIG. 15, in a routine called TU_CNTRL, the controller 254 of the lower tool 70 performs a series of steps to decode commands sent by the upper tool 50. In the TU_CNTRL routine, the controller 254 first monitors 364 the tubing pressure sensor 258. If the controller 254 determines 366 that a pressure pulse was detected, then the controller 254 decodes 368 the command. If the controller 254 recognizes 370 the command, the controller 254 actuates 372 the circulation valve 71 and the ball valve 72 of the lower tool 70 to perform the desired function. The controller 254 then returns to step 364.

In another embodiment, the ball valve 53 is located at the surface of the well. The ball valve 53 is controlled via electrical cables extending to the ball valve 53 (instead of through the pressure pulses 120 transmitted through the upper annulus 43).

Figure 16:
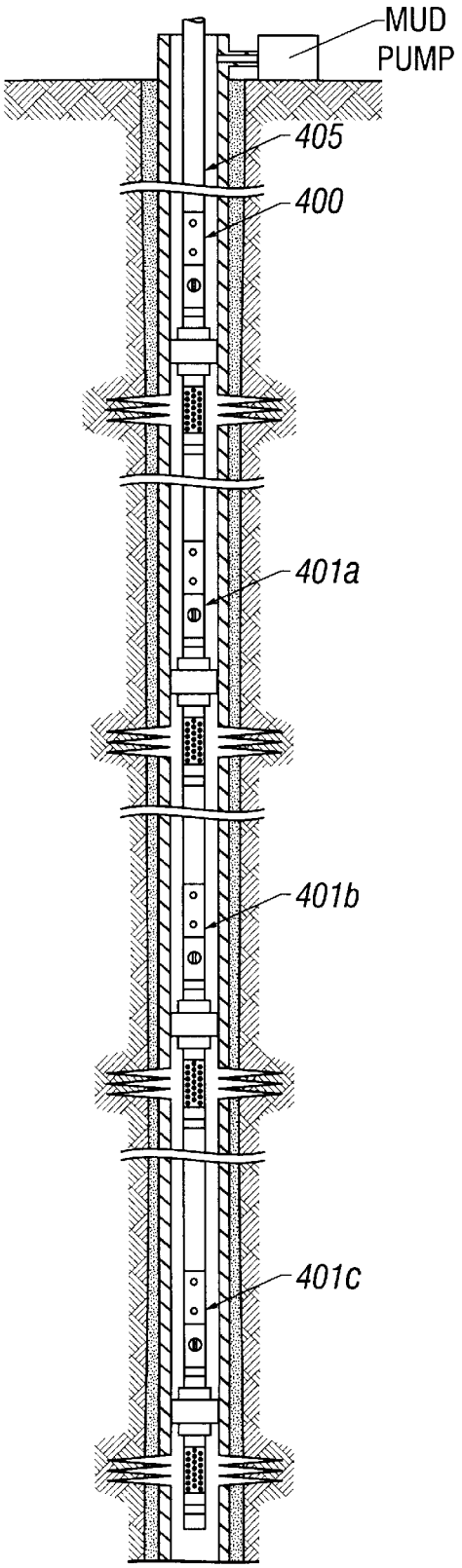
FIG. 16 is a schematic diagram illustrating another test string in a well being tested.

Other embodiments include a test string with more than two downhole tools. For example, as shown in FIG. 16, in a test string 405, one tool 400 generates commands for three tools 401*a–c* located downhole of the tool 400. In order to select the correct tool 401*a–c,* the tool 400 generates the same command more than once. The number of times the tool 400 generates the command identifies the recipient of the command. For example, for the tool 400 to transmit a command to the tool 401*c,* only one command is sent by the tool 400. For the tool 401*b,* the tool 400 sends two commands, and for the tool 401*a,* the tool 400 sends three commands.

Figure 17:
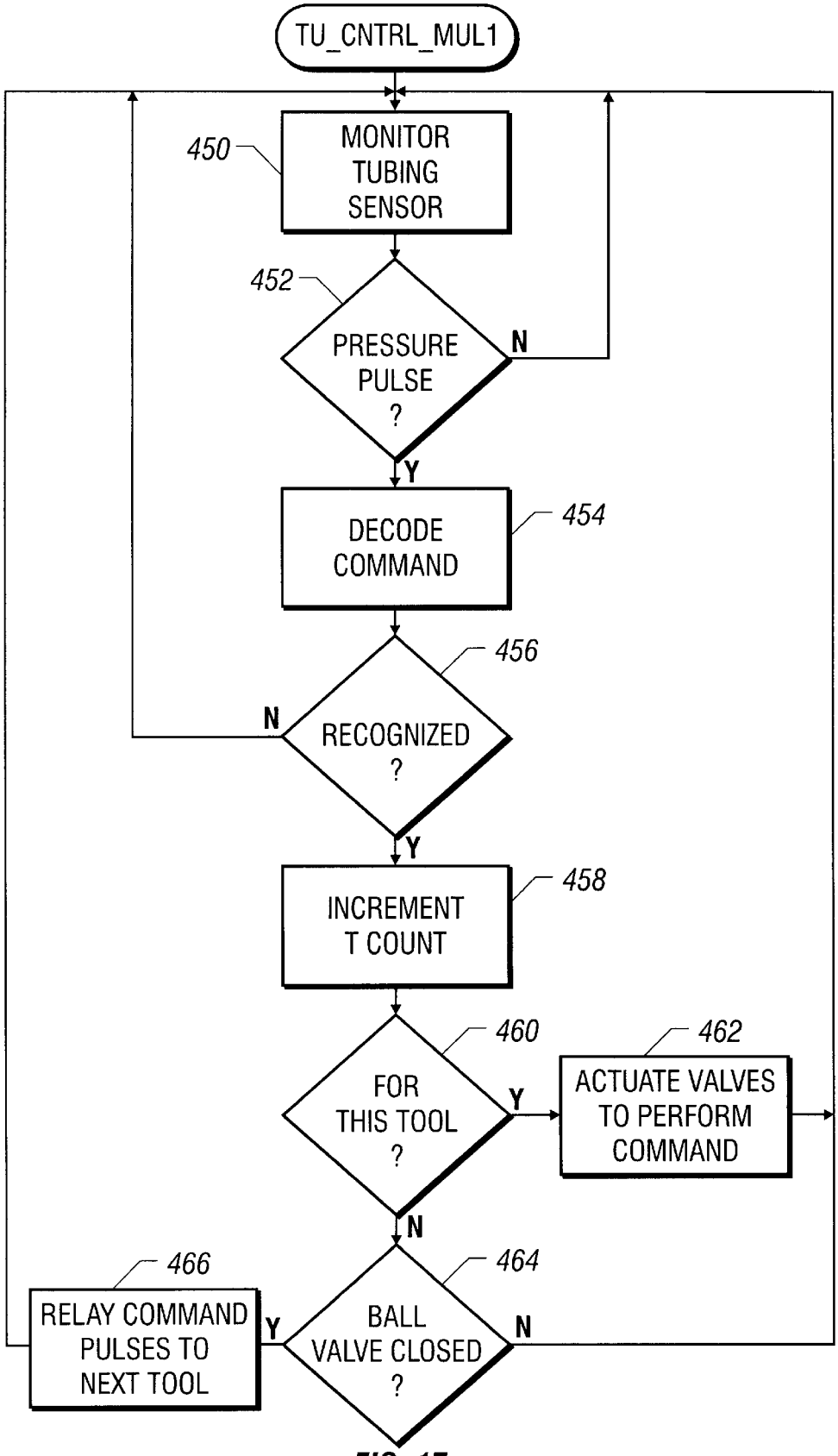
FIGS. 17 and 18 are flow diagrams illustrating the operation of electronics of tools of the test string.

As shown in FIG. 17, for the above-described sequencing method of addressing the tools 401*a–c,* the controller 254 in each of the tools 401*a–c* executes a routine called TU_CNTRL_MUL1. In the TU_CNTRL_MUL1 routine, the controller 254 monitors the pressure tubing sensor 258. If the controller 254 determines 452 that a pressure pulse was detected, then the controller 254 decodes 454 the command. If the controller 254 recognizes 456 the command, then the controller 254 increments 458 a parameter called TCOUNT (set equal to zero on reset of the electronics 250) which indicates the number of times the command has been detected. If the controller 254 determines 460 that the TCOUNT parameter indicates that the tool has been selected, then the controller 254 actuates 462 the valves to perform the command and returns to step 450. If the commands are for a tool located further downhole, then the controller 254 determines 464 whether the ball valve of the tool is closed (i.e., thereby indicating the command did not reach the next tool downhole). If not, the controller 254 returns to step 450. If, however, the ball valve was closed, then the controller 254 401 actuates the ball valve in a manner to send the command downhole.

Figure 18:
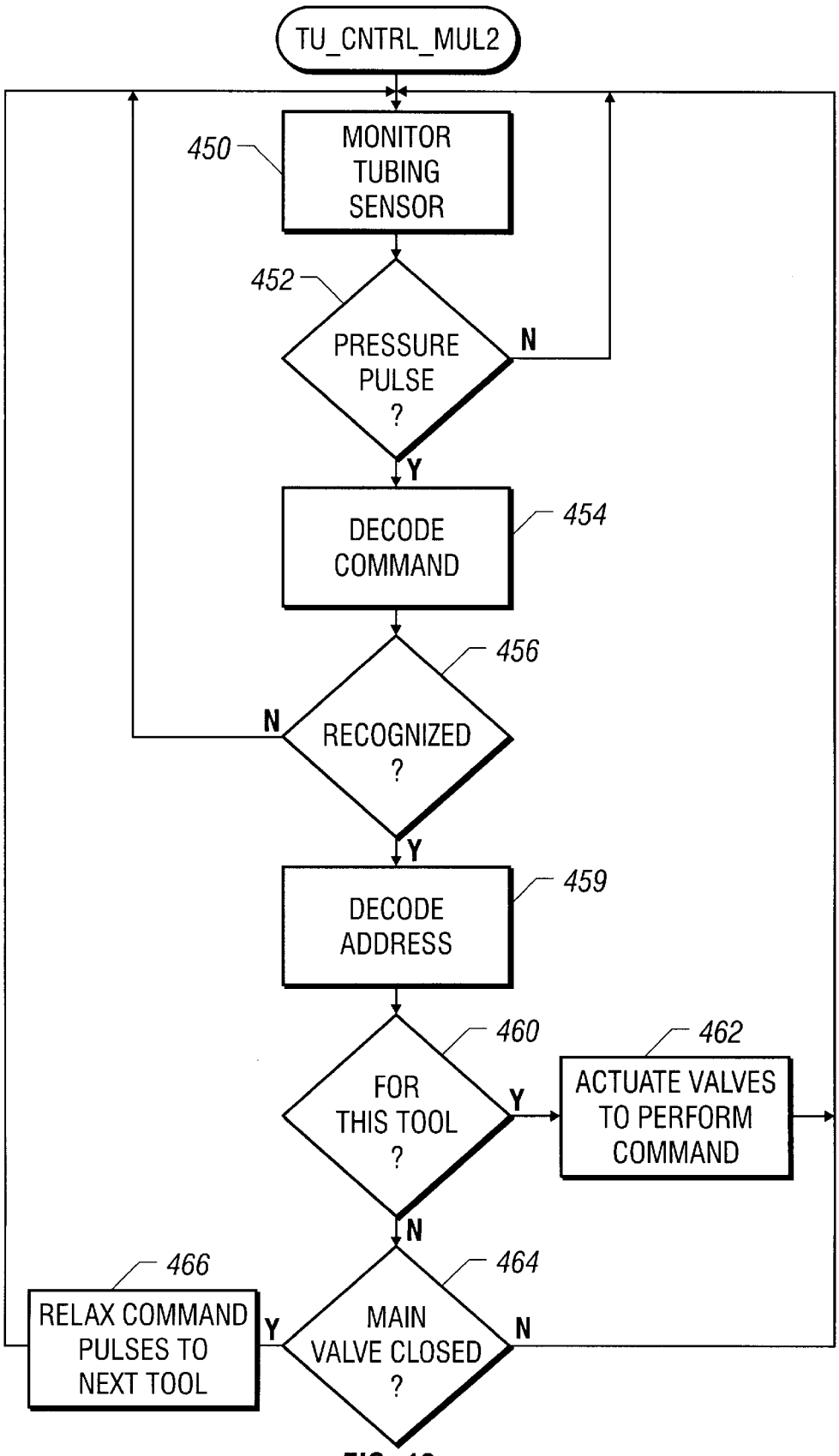

As shown in FIG. 18, in another embodiment, the tool 400 uses pressure pulses in the central passageway of the test string 405 to send an address with the command. The address uniquely identifies one of the downhole tools 401*a–c.* In this embodiment, the controller 254 for each of the tools 401*a–c* executes a routine called TU_CNTRL_MUL2. The TU_CNTRL_MUL2 routine is identical to the TU_CNTRL_MUL1 routine with the exception that step 458 is replaced with a step 478 in which the controller 254 decodes 478 the address sent by the tool 400.

Figure 19:
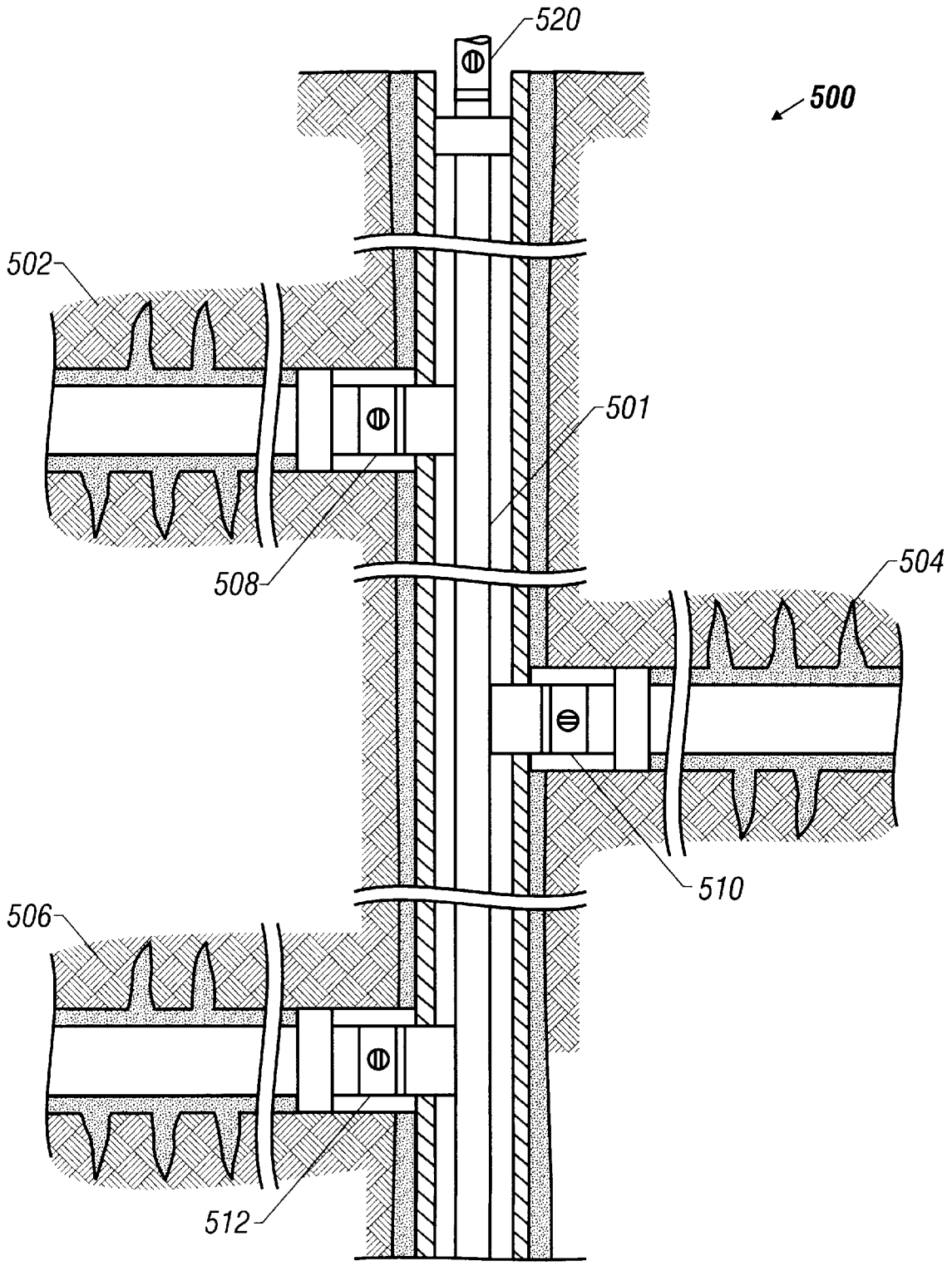
FIG. 19 is a cross-sectional view of a multi-lateral well.

As illustrated in FIG. 19, the control of downhole devices as discussed above may be extended beyond downhole testing strings. In FIG. 19, the principles are applied to an actual production environment. For example, a multi-lateral well 500 may have computer-controlled valve units 508–512 that control the flow of well fluid from lateral wellbores 502–506, respectively, to a trunk 501 of the well 500. Each of the valve units 508–512 has the same electronics 250 and hydraulics 249 discussed above along with a ball valve for controlling the flow of fluid through the central passageway of the valve unit. The flow of the well fluid through the trunk 501 is controlled by a valve unit 520, of similar design to the valve units 508–512.

Figure 20:
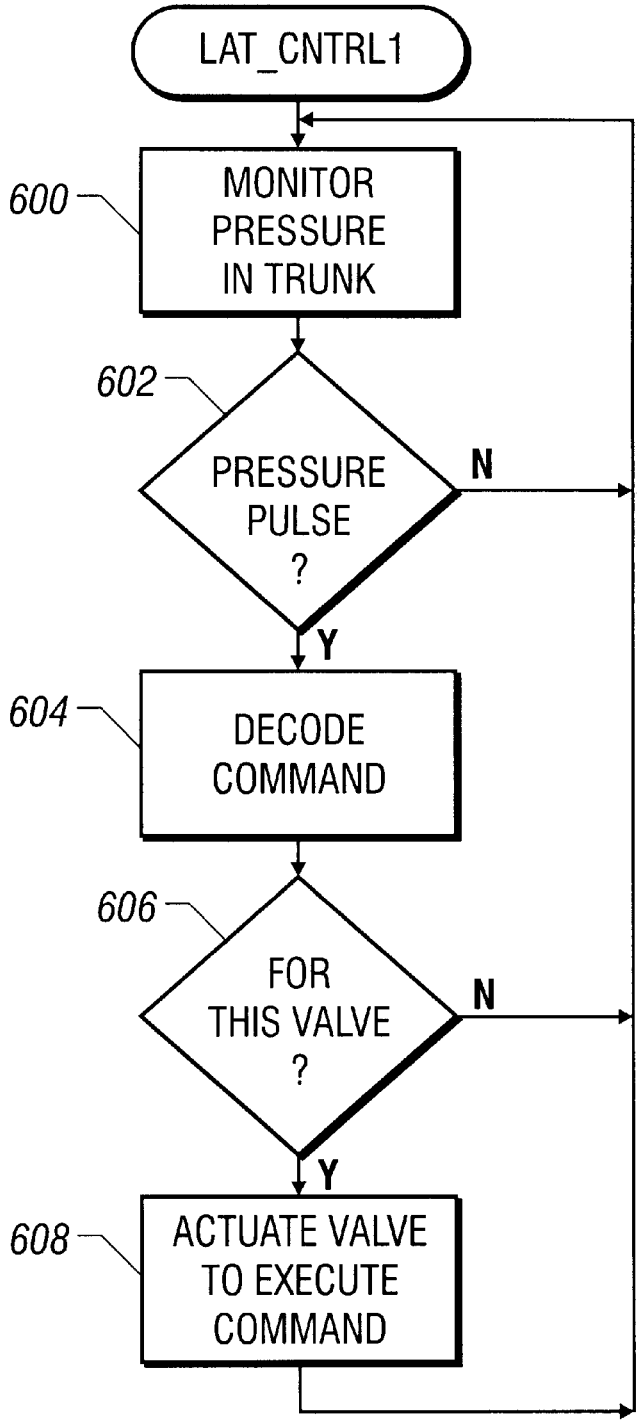
FIGS. 20 and 21 are flow diagrams illustrating the operation of valve units of FIG. 19.

As shown in FIG. 20, the controller 254 in each of the valve units 508–512 executes a routine called LAT_CNTRL1. In the LAT_CNTRL1 routine, the controller 254 monitors 600 the pressure in the trunk 501. If the controller 254 detects 602 a pressure pulse, then the controller 254 decodes 604 the command. If the controller 254 then recognizes 206 the command as being for the valve unit, the controller 254 actuates 608 the ball valve of the valve unit to execute the command.

Figure 21:
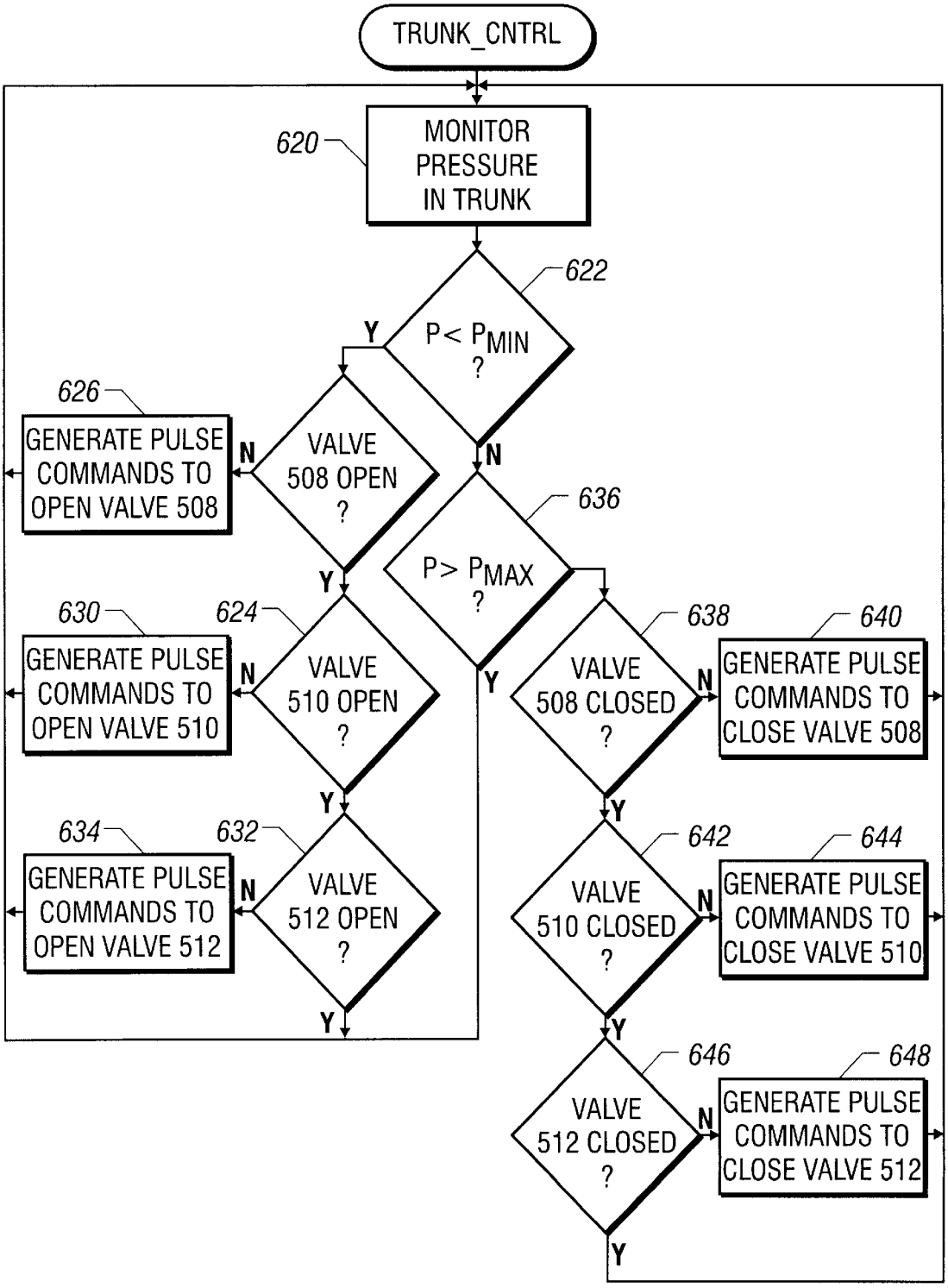

As shown in FIG. 21, the controller 254 for the valve unit 520 executes a routine called TRUNK_CNTRL. In the TRUNK_CNTRL routine, the controller 254 monitors 620 the pressure in the trunk 501. If the controller 254 determines 622 that the pressure has dropped below a predetermined minimum threshold, then the controller 254 performs 624–634 a series of operations to increase the pressure in the trunk 501. The controller 254 first determines 624 whether the valve 508 is open, and if not, the controller 254 then actuates 626 the ball valve of the unit 520 to generate a command to open the valve unit 508. The controller 254 then returns to step 620. If the valve unit 508 is open, then the controller 254 determines 628 whether the valve unit 510 is open, and if not, the controller 254 actuates 630 the ball valve of the valve unit 520 to generate a command to open the valve unit 510 and returns to step 620. If the valve unit 510 is open, then the controller 254 determines 632 whether the valve unit 512 is open, and if so, the controller 254 actuates 634 the ball valve of the unit 520 to generate a command to open the valve unit 512 and returns to step 620.

If the controller 254 determines 636 that the pressure in the trunk 501 is greater than a predetermined maximum threshold, then the controller performs 638–648 steps to reduce the pressure in the trunk. The controller 254 first determines 638 whether the valve unit 508 is closed, and if not, the controller 254 actuates 640 the ball valve of the valve unit 520 to send a command to close the valve unit 508 and returns to step 620. If the controller 254 determines 642 that the valve unit 510 is closed, then the controller 254 actuates 644 the ball valve of the unit 520 to send a command to close the valve unit 510 and returns to step 620. If the controller 254 determines 646 that the valve unit 512 is closed, then the controller 254 actuates 648 the ball valve of the valve unit 520 to send a command to close the valve 512 and returns to step 620.

In other embodiments, the valve unit 520 is located at the surface of the well. The valve unit 520 is controlled via electrical cables connected to the valve unit 520.

Other embodiments are within the scope of the following claims. For example, instead of using the mud pump 39 to generate a single command to instruct the upper tool 50 to generate a command for the lower tool 70, in an alternative embodiment, a series of commands is sent by the mud pump 39 to directly control the opening and closing of the ball valve 53 in the generation of the command for the lower tool 70.

While the invention has been disclosed with respect to a limited number of embodiments, those skilled in the art, having the benefit of this disclosure, will appreciate numerous modifications and variations therefrom. It is intended that the appended claims cover all such modifications and variations as fall within the true spirit and scope of the invention.

What is claimed is:

1. A system for use in a subterranean well, the system comprising:

a command generator configured to furnish a first stimulus downhole indicative of a first encoded command;

a first assembly located downhole and having a first member, the assembly connected to decode the first stimulus to extract the first encoded command and move the first member in response to the first encoded command to generate a second stimulus indicative of a second encoded command; and a second assembly located downhole and connected to decode the second stimulus to extract the second encoded command and respond to the second encoded command.

2. The system of claim 1, wherein the second assembly has a second member, and wherein the second assembly is connected to actuate the second member in response to the second encoded command.

3. The system of claim 1, wherein the first assembly comprises:

a sensor; and a control system connected to use the sensor to extract the first encoded command and connected to actuate the first member in response to the first encoded command being extracted.

4. The system of claim 3, wherein the control system includes a hydraulic system.

5. The system of claim 1, wherein the second assembly comprises:

a sensor; and a control system to use the sensor to extract the second encoded command and connected to actuate a second member in response to the second encoded command being extracted.

6. The system of claim 5, wherein the control system includes a hydraulic system.

7. The system of claim 1, wherein the first assembly comprises a downhole tool.

8. The system for claim 1, wherein the second assembly comprises a downhole tool.

9. The system of claim 1, wherein the first member comprises a valve.

10. The system of claim 1, wherein the second moveable member comprises a valve.

11. The system of claim 1 further comprising a tubing extending between the first and second assemblies.

12. The system of claim 11 wherein the tubing is filled with a fluid, and wherein the second stimulus comprises pressure pulses in the fluid.

13. The system of claim 1, wherein the second assembly is located downhole of the first assembly, wherein a tubing extends between the first and second assemblies, the system further comprising:

a packer located between the first and second assemblies, the packer forming a seal between a first annulus surrounding the first assembly and a second annulus surrounding the second assembly, wherein the first annulus contains a fluid and wherein the first stimulus comprises pressure pulses in the fluid.

14. A string for use in a subterranean well, the string comprising:

a tubular housing having a central passageway;

a first tool having a first valve positioned to control fluid in the central passageway, the first tool connected to detect and decode a first stimulus indicative of a first encoded command and operate the first valve in response to the first encoded command to generate a second stimulus in the fluid indicative of a second encoded command; and a second tool having a member, the second member connected to detect and decode the second stimulus to extract the second encoded command and actuate the member in response to the second encoded command.

15. The string of claim 14, wherein the first tool has a sensor located on the exterior of the housing and connected to receive the first stimulus.

16. A production system for use in a subterranean well, comprising:

a first tubing extending into a bore of the well, the first tubing having a central passageway;

a second tubing extending into another bore of the well, the second tubing having a central passageway;

a first valve positioned to control the flow of fluid in the central passageway of the first tubing, the first valve connected to detect and decode a first stimulus indicative of a first encoded command and operate in response to the first encoded command, wherein the operation of the first valve generates a second stimulus in the fluid of the first tubing indicative of a second encoded command; and a second valve configured to decode the second stimulus to extract the second encoded command and control the flow of fluid from the central passageway of the first tubing to the central passageway of the second tubing in response to the second encoded command.

17. A method for use in a subterranean well, the method comprising:

furnishing a first stimulus downhole indicative of a first encoded command;

decoding the first command stimulus to extract the first encoded command;

moving a first downhole member in response to the first encoded command to generate a second stimulus indicative of a second encoded command;

decoding the second stimulus to extract the second encoded command; and operating a downhole tool in response to the second encoded command.

18. The method of claim 17, wherein the moving the first member includes using a downhole tool.

19. The method of claim 17, wherein the step of using the second stimulus includes moving a second downhole member.

20. The method of claim 19, wherein the second member comprises a valve.

21. The method of claim 19, wherein the first member comprises a valve.

22. The method of claim 17, wherein the second stimulus is located inside a tubing extending between the first and second assemblies.

23. The method of claim 22 wherein the tubing is filled with a fluid, and wherein the second stimulus comprises pressure pulses.

24. A method for use in a subterranean well, the method comprising:

furnishing a first stimulus downhole indicative of a first encoded command;

decoding the first stimulus to extract the first encoded command;

operating a first valve in response to the first encoded command to generate a second stimulus indicative of a second encoded command inside a central passageway of a tubular housing extending downhole;

decoding the second stimulus to extract the second encoded command; and operating a downhole tool in response to the second encoded command.

* * * * *